US011618146B2

(12) United States Patent
Li et al.

(10) Patent No.: US 11,618,146 B2
(45) Date of Patent: Apr. 4, 2023

(54) SAFETY STRUCTURE USED IN THE ANTI-AUTO-FIRING DEVICE OF ELECTRIC NAIL GUNS

(71) Applicants: Xiaorong Li, Zhejiang (CN); Xiaopeng Li, Zhejiang (CN); Zhonghua Jiang, Zhejiang (CN)

(72) Inventors: Xiaorong Li, Zhejiang (CN); Xiaopeng Li, Zhejiang (CN); Zhonghua Jiang, Zhejiang (CN)

(73) Assignee: Zhejiang Rongpeng Air Tools Co., Ltd., Zhejiang (CN)

( * ) Notice: Subject to any disclaimer, the term of this patent is extended or adjusted under 35 U.S.C. 154(b) by 107 days.

(21) Appl. No.: 17/129,809

(22) Filed: Dec. 21, 2020

(65) Prior Publication Data

US 2022/0193873 A1 Jun. 23, 2022

(51) Int. Cl.
*B25C 1/06* (2006.01)
*B25C 1/00* (2006.01)

(52) U.S. Cl.
CPC ..... *B25C 1/06* (2013.01); *B25C 1/008* (2013.01)

(58) Field of Classification Search
CPC ..... B25C 1/06; B25C 1/008
See application file for complete search history.

(56) References Cited

U.S. PATENT DOCUMENTS 5,522,532 A * 6/1996 Chen ..... B25C 1/008 227/8
6,123,241 A * 9/2000 Walter ..... B25C 1/008 227/8
RE42,987 E * 12/2011 Akiba ..... B25C 1/008 227/8
2006/0180628 A1* 8/2006 Hung ..... B25C 1/008 227/8
2008/0197165 A1* 8/2008 Chen ..... B25C 1/008 227/8
2008/0296337 A1* 12/2008 Yang ..... B25C 1/008 227/8
2009/0159633 A1* 6/2009 Wu ..... B25C 1/008 227/8
2009/0194573 A1* 8/2009 Liang ..... B25C 1/06 227/129
2009/0250498 A1* 10/2009 Chen ..... B25C 1/008 227/8
2010/0147919 A1* 6/2010 Schiestl ..... B25C 1/06 227/132

(Continued)

*Primary Examiner* — Thomas M Wittenschlaeger
*Assistant Examiner* — Katie L Gerth

(57) ABSTRACT

A safety structure used in the anti-auto-firing device of electric nail guns, including a base cover and an anti-auto-firing device. The anti-auto-firing device comprises a safety rack, an adjusting-connecting device, an on-off lever, an inching switch and a return spring. A safety device is fitted over the on-off lever. The safety device comprises a retaining ring, a bearing elastic piece and a locating spacer. A support plate is disposed in the base cover. The support plate is provided with a lever slot, the retaining ring is fixed to the on-off lever. Both ends of bearing elastic piece prop the retaining ring and locating spacer respectively. The locating spacer props the side of support plate. The bearing elastic piece has elastic force keeping the end of on-off lever away from the inching switch.

5 Claims, 2 Drawing Sheets

(56) References Cited

U.S. PATENT DOCUMENTS

| | | | | |
|---|---|---|---|---|
| 2010/0187278 | A1* | 7/2010 | Lin | B25C 1/008 227/107 |
| 2017/0274511 | A1* | 9/2017 | Huang | B25C 5/06 |
| 2018/0093370 | A1* | 4/2018 | Yip | B25C 1/005 |
| 2020/0189078 | A1* | 6/2020 | Theberath | B25C 1/047 |
| 2020/0282534 | A1* | 9/2020 | Po | B25C 1/06 |

* cited by examiner

SAFETY STRUCTURE USED IN THE ANTI-AUTO-FIRING DEVICE OF ELECTRIC NAIL GUNS

BACKGROUND OF INVENTION

1. Field of the Invention

The present invention relates generally to the technical field of electric nail guns, and more particularly to a safety structure used in the anti-auto-firing device of electric nail guns.

2. Description of Related Art

At present, the electric nail guns are extensively used in the machining industry, which use high pressure gas as power source to actuate the mechanism to drive nails. In order to guarantee the operational safety of nail guns, most nail guns are provided with an anti-auto-firing device, so as to avoid touching the trigger by accident which will cause potential safety hazard.

The existing anti-auto-firing device comprises a safety rack, an on-off lever, an inching switch and a return spring. In the operation of the device, the safety rack is pressed to push the on-off lever till its end contacts the inching switch, so as to control the nailing of nail gun. The operational safety of the existing anti-auto-firing device has been enhanced to a great extent, in order to protect the nailing head of nail gun against damage due to collision in the position where it is placed after use, the whole nail gun is placed upright, but all the gravities of the components of anti-auto-firing device act on the on-off lever, so that the inching switch is pushed into on-state. When there are nails left in the nail magazine and the trigger is touched by accident, the nail gun fires automatically, causing potential safety hazard, Therefore, it is very important to solve this potential safety hazard.

SUMMARY OF THE INVENTION

The technical problem to be solved in the present invention is to provide a safety structure used in the anti-auto-firing device of electric nail guns.

In order to solve the above problems, the present invention adopts the following technical solutions:

A safety structure used in the anti-auto-firing device of electric nail guns, including a base cover, an anti-auto-firing device and a fixing plate, wherein the anti-auto-firing device includes a safety rack, an adjusting-connecting device, an on-off lever, an inching switch and a return spring; the safety device is fitted over the on-off lever and includes a retaining ring, a bearing elastic piece and a locating spacer, a support plate for locating the safety device is disposed in the base cover, the support plate is provided with a lever slot, the on-off lever passes through the lever slot, the components of the safety device are arranged on the same side of support plate, the retaining ring is fixed to the on-off lever, one end of bearing elastic piece props the retaining ring, the other end props the locating spacer, the locating spacer props the side of support plate, the bearing elastic piece has elastic force keeping the end of on-off lever away from the inching switch, so as to cancel out the gravity of anti-auto-firing device.

More particularly, wherein the on-off lever is provided with a locating ring, the locating ring is fixed to the on-off lever, it and the locating spacer are located on both sides of support plate respectively.

More particularly; wherein the bearing elastic piece is a spring component, fitted over the on-off lever.

More particularly, wherein the retaining ring is a split retaining ring, the on-off lever is provided with a locating slot for mounting the split retaining ring.

More particularly, wherein the locating ring and on-off lever are arranged in one structure.

The present invention has the following benefits:

The on-off lever of anti-auto-firing device of the present invention is provided with a safety device, the safety device has elastic force keeping the on-off lever away from the inching switch, so when the nail gun is placed upright, the elastic force of the bearing elastic piece in the safety device acting on the on-off lever can balance out the gravity of anti-auto-firing device, the on-off lever will not move down, so as to avoid touching the inching switch to enter on-state, and to avoid touching the trigger by accident to induce automatic firing, the operational safety is enhanced.

DETAILED DESCRIPTION OF THE INVENTION

The present invention is further described with attached figures.

Figure 1:
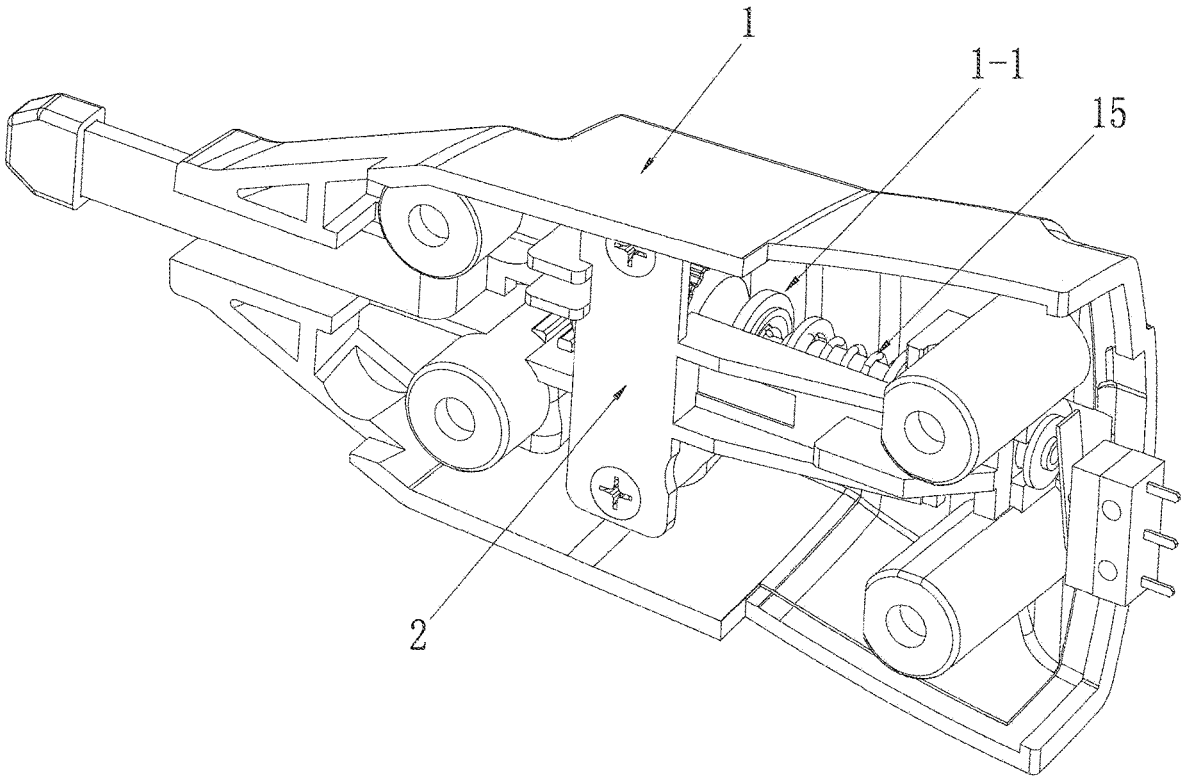
FIG. 1 is a perspective view of the present invention.
Figure 2:
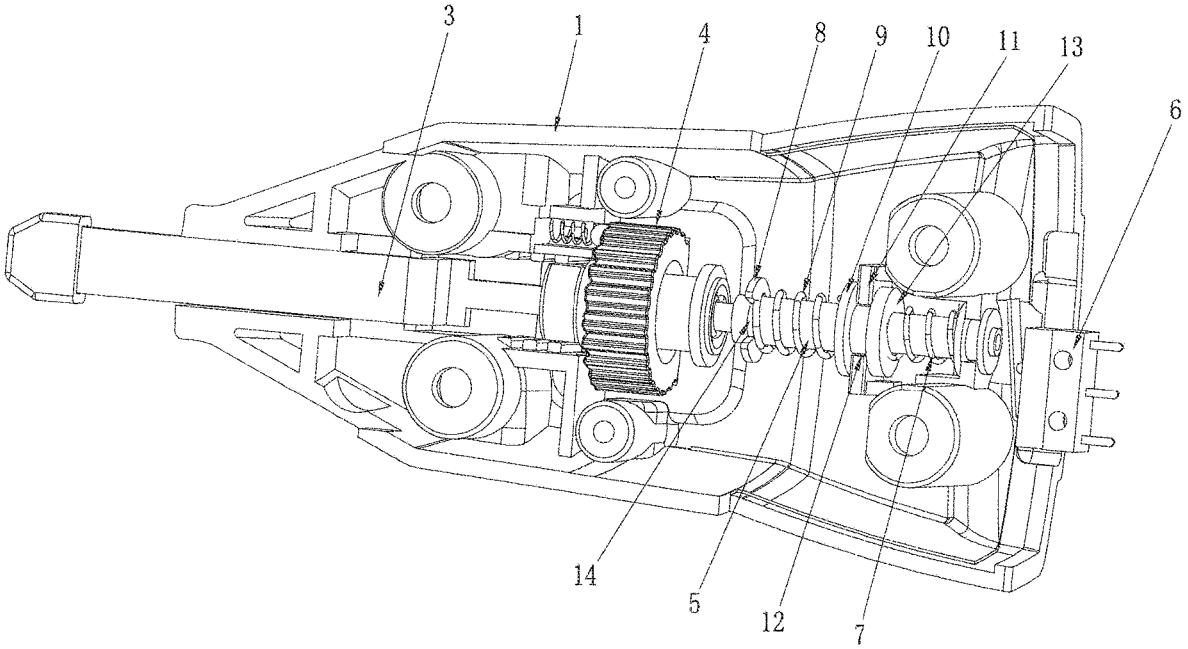
FIG. 2 is a perspective view of the present invention from another angle (excluding fixing plate).

FIG. 1 and FIG. 2 show a safety structure used in the anti-auto-firing device of electric nail guns, including a base cover 1, an anti-auto-firing device 1-1 and a fixing plate 2 locating the anti-auto-firing device 1-1 in the base cover 1. The anti-auto-firing device comprises a safety rack 3, an adjusting-connecting device 4, an on-off lever 5, an inching switch 6 and a return spring 7. One end of on-off lever 5 is linked with the safety rack 3 via the adjusting-connecting device 4, the other end can touch and turn on the inching switch 6. The return spring 7 restores the movement of on-off lever 5. A safety device 15 is fitted over the on-off lever 5. The safety device comprises a retaining ring 8, a bearing elastic piece 9 and a locating spacer 10. A support plate 11 for locating the safety device 15 is disposed in the base cover 1. The support plate 11 is provided with a lever slot 12, the on-off lever 5 passes through the lever slot 12, as well as passes through the bearing elastic piece 9 and locating spacer 10, and it can move. The components of the safety device 15 are on the same side of support plate 11. The retaining ring 8 is fixed to the on-off lever 5. One end of bearing elastic piece 9 contacts the retaining ring 8, the other end contacts the locating spacer 10. The locating spacer 10 contacts the side of support plate 11. The bearing elastic piece 9 has elastic force keeping the end of on-off lever 5 away from the inching switch 6, so as to cancel out the gravity of anti-auto-firing device 1-1.

For normal use, the safety rack 3 is pressed, the adjusting-connecting device 4 props the on-off lever 5, the on-off lever 5 moves together with the retaining ring 8 of safety device 15. When they are moving, the return spring 7 and bearing elastic piece 9 are compressed. When the on-off lever 5 is moving, its end touches the inching switch 6 to enter on-state, so that the nail gun trigger is pulled to perform nailing operation. When the pressure on safety rack 3 is stopped, the on-off lever 5 is restored under the elastic force of return spring 7 and bearing elastic piece 9, so that the inching switch 6 is turned off, and the nail gun cannot be operated.

After the use of nail gun, in order to protect the nailing head of nail gun against damage due to collision in the position where it is placed, the nail gun is placed upright, all the gravities of the components of anti-auto-firing device 1-1 act on the on-off lever 5. As the bearing elastic piece 9 has elastic force keeping the end of on-off lever 5 away from the inching switch 6, meaning the direction of elastic force is opposite to the direction of gravity of components of anti-auto-firing device 1-1, the bearing elastic piece 9 in the safety device 15 cancels out the gravity of anti-auto-firing device 1-1, so as to avoid the gravity of anti-auto-firing device 1-1 acting on the on-off lever 5 to prop and turn on the inching switch 6 when the nail gun is placed upright, and to avoid touching, the nail gun trigger by accident which is a potential safety hazard.

Secondly, the on-off lever 5 is provided with a locating ring 13, the locating ring 13 is fixed to the on-off lever 5, it and the locating spacer 10 are located on both sides of the support plate 11 respectively. The locating ring 13 can prop the side of support plate 11, so as to position the movement of on-off lever 5 towards the safety rack 3, and to avoid the elastic force of hearing elastic piece 9 in the safety device acting on the on-off lever 5 to cause excessive movement.

Thirdly, the bearing elastic piece 9 is a spring component, fitted over the on-off lever 5, the bearing elastic piece 9 can be other elastic components.

Fourthly, for convenient processing and assembly/disassembly, the retaining ring 8 is a split retaining ring, the on-off lever 5 is provided with a locating slot 14 for mounting the split retaining ring. Certainly, the retaining ring 8 can be integrated with the on-off lever 5 during processing.

Additionally, the locating ring 13 and on-off lever 5 are arranged in one structure, and they can be a separate structure like retaining ring 8, the form can be selected as required.

We claim:

1. A safety structure used in an anti-auto-firing device of electric nail guns, including a base cover and a fixing plate, wherein the anti-auto-firing device includes a safety rack, an adjusting-connecting device, an on-off lever, an inching switch and a return spring; a safety device is fitted over the on-off lever and includes a retaining ring, a bearing elastic piece and a locating spacer, a support plate for locating the safety device is disposed in the base cover, the support plate is provided with a lever slot, a portion of the on-off lever lies in the lever slot, the components of the safety device are arranged on the same side of the support plate, the retaining ring is fixed to the on-off lever, one end of the bearing elastic piece abuts the retaining ring, the other end of the bearing elastic piece abuts the locating spacer, the locating spacer abuts the side of the support plate, the bearing elastic piece has elastic force keeping the end of the on-off lever away from the inching switch.

2. The safety structure used in the anti-auto-firing device of electric nail guns according to claim 1, wherein the on-off lever is provided with a locating ring, the locating ring is fixed to the on-off lever and is located on both sides of the support plate with the locating spacer.

3. The safety structure used in the anti-auto-firing device of electric nail guns according to claim 1, wherein the bearing elastic piece is a spring component, fitted over the on-off lever.

4. The safety structure used in the anti-auto-firing device of electric nail guns according to claim 1, wherein the retaining ring is a split retaining ring, the on-off lever is provided with a locating slot for mounting the split retaining ring.

5. The safety structure used in the anti-auto-firing device of electric nail guns according to claim 2, wherein the locating ring and the on-off lever are arranged in one structure.

* * * * *